US006345798B1

(12) United States Patent
Bondhus et al.

(10) Patent No.: US 6,345,798 B1
(45) Date of Patent: Feb. 12, 2002

(54) LOW-COST HOLDER FOR LABELING AND DISPLAYING TOOLS

(75) Inventors: John R. Bondhus, Buffalo; Michael D. Blackston, Plymouth; Eric G. Bondhus, Monticello; Mark L. Petroske, Becker, all of MN (US)

(73) Assignee: Bondhus Corporation, Monticello, MN (US)

( * ) Notice: Subject to any disclaimer, the term of this patent is extended or adjusted under 35 U.S.C. 154(b) by 0 days.

(21) Appl. No.: 09/286,157

(22) Filed: Apr. 5, 1999

(51) Int. Cl.[7] ..... A47F 5/00
(52) U.S. Cl. ..... 248/314; 211/70.6; 211/89.01
(58) Field of Search ..... 248/309.1, 314, 248/315, 688; 211/70.6, 60.1, 89.01; 206/493, 463, 462, 349, 377, 480, 481, 482, 806

(56) References Cited

U.S. PATENT DOCUMENTS 3,603,551 A * 9/1971 Peterson ..... 248/314
3,630,385 A * 12/1971 Searcy ..... 211/88
5,373,939 A * 12/1994 Bloomgren ..... 206/341
5,513,758 A * 5/1996 Lin ..... 211/70.6
5,803,253 A * 9/1998 Zakarian ..... 206/349
5,816,401 A * 10/1998 Vasudeva et al. ..... 206/377
5,967,340 A * 10/1999 Kao ..... 211/70.6
5,979,652 A * 11/1999 Rosler ..... 206/481
6,112,897 A * 9/2000 Hu ..... 206/377

* cited by examiner

*Primary Examiner*—Anita King
*Assistant Examiner*—Gwendolyn Baxter
(74) *Attorney, Agent, or Firm*—Faegre & Benson LLP

(57) ABSTRACT

A low-cost holder for labeling and displaying a tool. A tool can be inserted into the holder using high-speed automated assembly equipment. The tools are typically hex wrenches, screwdrivers, TORX drivers, open end wrenches, box end wrenches or some combination thereof. The holder includes a substrate having at least one housing defining a tool conduit with first and second openings. The tool conduit defines a cross sectional area capable of receiving the tool. At least one tool retaining structure extends across at least a portion of the tool conduit so that a frictional engagement force is generated between the tool and the tool retaining structure. The housing, substrate and tool retaining structure are integrally formed as a unitary structure.

25 Claims, 4 Drawing Sheets

LOW-COST HOLDER FOR LABELING AND DISPLAYING TOOLS

FIELD OF THE INVENTION

The present invention relates to a low-cost holder for labeling and displaying tools that can be used with high speed automated assembly equipment.

BACKGROUND OF THE INVENTION

Low cost tools, such as hex wrenches, screwdrivers, TORX drivers, and the like, are often packaged by shrink-wrapping individual items to a cardboard backing. The cardboard backing typically displays information about the tool, such as a Universal Product Code. This packaging approach requires an individual backing be printed for each type of tool. In some situations, the cost of the packaging can exceed the cost of the tool. Alternatively, such tools may be displayed unpackaged in large bins.

In order to justify the packaging cost, some low cost hand tools are sold as a set. A group of these tools is typically assembled in a pouch or other container for easy packaging and display. This packaging approach requires the consumer to purchase several tools, when only one may be required.

Sears Corporation of Chicago, Ill., offers tools under the Craftsman trademark in a holder that can be hung on a merchandise rack. The holder has a structure with an opening for receiving the tool. A washer-shaped insert having a center hole corresponding to the size of the tool is inserted into the structure. This two piece assembly does not lend itself to automated assembly. Additionally, the cost of manufacturing the holder and assembling the holder and tool can be a significant percentage of the cost of a low cost tool. It is difficult for tools packaged in this manner to compete with unpackaged tools.

What is needed is a low cost holder for labeling and displaying tools that lends itself to high speed, automated assembly.

BRIEF SUMMARY OF THE INVENTION

The present invention is directed to a low-cost holder for labeling and displaying a tool. A tool can be inserted into the present holder using high-speed automated assembly equipment. The present invention is also directed to a combination of the present holder and a tool. Some examples of tools that can be used with the present tool holder include hex wrenches, screwdrivers, TORX drivers, open end wrenches, box end wrenches or some combination thereof.

In the illustrated embodiment, the holder includes a substrate having at least one housing defining a tool conduit with first and second openings. The tool conduit defines a cross sectional area capable of receiving the tool. At least one tool retaining structure extends across at least a portion of the tool conduit so that a frictional engagement force is generated between the tool and the tool retaining structure. The housing, substrate and tool retaining structure are integrally formed as a unitary structure. The housing and the substrate may be constructed from one or more polymeric materials, such as an elastomeric material, aluminum, spring steel or the like.

In one embodiment, the tool retaining structure extends across at least a portion of the first or second openings. The tool retaining structure may be a resilient material, such as a foam or an elastic material located in the tool conduit, an aperture having a shape different than a cross sectional shape of the tool, an aperture in the tool retaining structure smaller than a cross sectional area of the tool, or a longitudinal slit generally along the tool conduit that permits flexure of the housing during insertion and removal of a tool. In another embodiment, the tool retaining structure is integral with the housing. For example, the housing may include one or more depressions that extend into a portion of the tool conduit. The tool retaining structure may also include a frangible portion. In the illustrated embodiments, the frangible portions are perforations or slits in the tool retaining structure.

The tool retaining structure refers to material extending across or into at least a portion of the tool conduit to engage frictionally with a tool. The tool retaining structure can be a wall, a ridge or a raised portion that deforms to retain releasably a tool in the tool conduit. In one embodiment, the tool retaining structure is part of the housing, the substrate, or both. Frangible portion refers to cuts, slits, perforations, apertures, points of weakness or other discontinuities in the tool retaining structure and/or a material that is broken or deformed, elastically or inelastically, when a tool is inserted through the tool conduit, so that a frictional engagement force is generated between the tool and the tool retaining structure.

A substrate mounting hole may optionally be provided in the substrate to permit hanging of the present holder on a merchandise rack or tool rack. In the illustrated embodiment, the substrate, housing, and tool retaining structure are integrally formed as a unitary structure from one or more polymeric materials. It is also possible to locate a plurality of housings on a single substrate or sheet structure. Perforations can be provided so that an individual tool and its respective tool holder can be separated from the sheet of tools. The holder may have two or more housings.

The present invention is also directed to a method for labeling and displaying a tool. The method includes forming a unitary structure of at least one housing defining a tool conduit with a first and second opening, a tool retaining structure across at least a portion of the tool conduit and a frangible portion on the tool retaining structure. A tool is then inserted through the tool conduit so that the tool retaining structure is deformed to engage frictionally with the tool. A label may be applied to the label receiving surface. An in-line label printer may optionally be used for this purpose.

BRIEF SUMMARY OF THE INVENTION

Figure 1A:
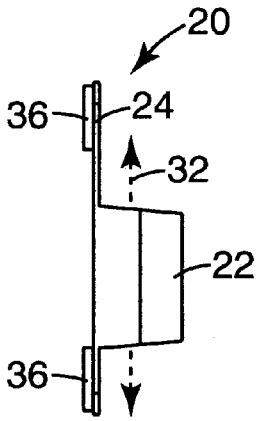
FIG. 1A is side sectional view of a tool holder in accordance with the present invention.
Figure 1B:
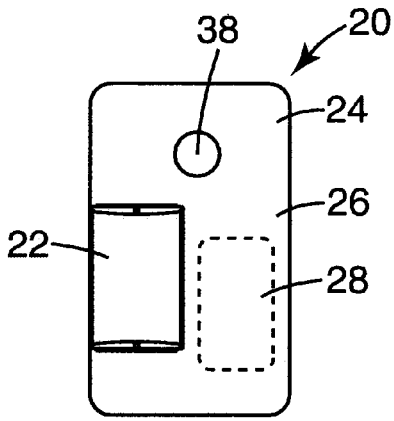
FIG. 1B is a front view of the tool holder of FIG. 1A.

FIGS. 1A and 1B illustrate a tool holder 20 in accordance with the present invention. The tool holder 20 includes a housing 22 located on a substrate 24. The substrate 24 includes an information receiving surface 26 for displaying information about the tool. In one embodiment, the information is displayed on a label 28. Alternatively, the information can be molded directly into the information receiving surface 26. The housing 22 forms a tool conduit 30 (see for example, FIG. 2C) through which a tool (see FIG. 7A) extends parallel to an axis 32. A substrate mounting hole 38 is optionally formed in the substrate 24 so that the tool holder 20 can be located on a merchandise display or an end-user's tool rack.

In one embodiment, the rear surface 34 of the substrate 24 may optionally include an adhesive 36. The adhesive 36 may be used for attaching the tool holder 20 to a merchandise display. Alternatively, the end-user can use the adhesive layer 36 for attaching the tool holder 20 to a variety of surfaces, such as a tool rack, a tool box, or the like. A variety of adhesives 36 may be used, such as pressure sensitive adhesives, thermosetting or thermoplastic adhesives, radiation cured adhesives, adhesives activated by solvents, and blends thereof. Many suitable epoxy, urethane, synthetic or natural based rubber and acrylic adhesives are commercially available for this purpose as well. Depending upon the application, the adhesive may releasably bond or permanently bond the substrate 24 to a surface. The substrate 24 may optionally be laminated or impregnated with the adhesive.

Figure 2A:
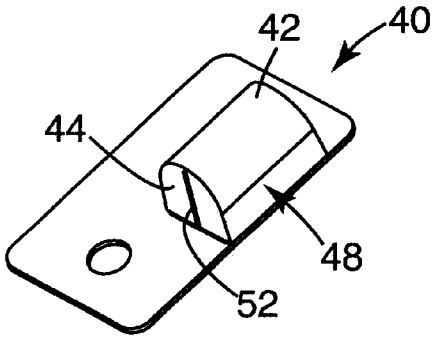
FIGS. 2A, 2B and 2C are perspective views of an alternate tool holder in accordance with the present invention.
Figure 2B:
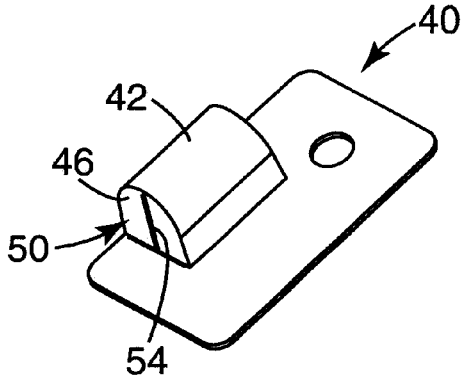
Figure 2C:
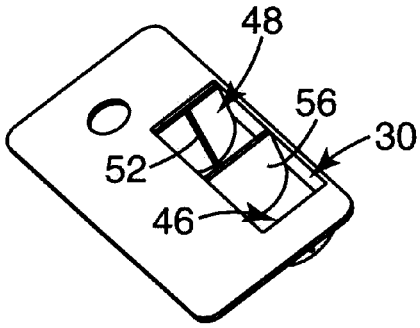

FIGS. 2A, 2B and 2C are perspective views of a tool holder 40 in accordance with the present invention. The housing 42 includes a top tool retaining structure 44 and a bottom tool retaining structure 46 extending across the top opening 48 and bottom opening 50, respectively, to the tool conduit 30. The tool retaining structures 44, 46 each include a frangible portion 52, 54, respectively, that facilitate deformation during insertion of a tool. The tool retaining structures 44, 46 deform to engage frictionally with the tool so that it is retained to the tool holder 40. In an alternate embodiment, one or more additional tool retaining structures or walls 56 may be located along the tool conduit 30 between the first and second openings 46, 48, respectively.

Figure 3:
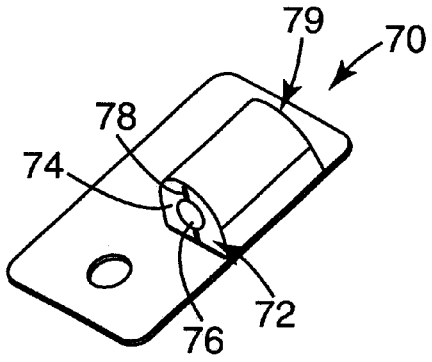
FIG. 3 is a perspective view of an alternate tool holder with an aperture as part of the frangible portion in accordance with the present invention.

FIG. 3 is an alternate tool holder 70 in accordance with the present invention. Tool retaining structure 74 extends across a portion of a first opening 72. In the embodiment of FIG. 3, the tool retaining structure 74 is a thin membrane or film of a polymeric material. The tool retaining structure 74 includes an aperture 76 that is smaller than the cross sectional area of a tool. Frangible slits or perforations 78 may optionally be located around the periphery of the aperture 76 to accommodate larger tools. The second opening 79 may optionally also include a tool retaining structure.

Figure 4:
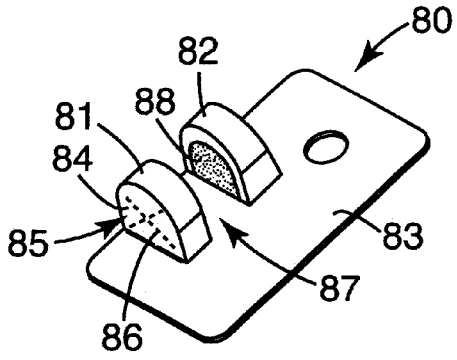
FIG. 4 is a perspective view of an alternate tool holder with a frangible portion including a series of perforations in accordance with the present invention.

FIG. 4 is a perspective view of an alternate tool holder 80 having two separate housings 81, 82 located on a single substrate 83. The housing 81 has a tool retaining structure 84 extending across the opening 85. In the illustrated embodiment, the tool retaining structure 84 is a thin film or membrane having a plurality of perforations 86 arranged in a non-linear pattern. In the illustrated embodiment, the perforations 84 form a cross pattern. A variety of other patterns may also be utilized. The housing 82 is filled with an elastic material 88, such as for example an open-celled foam. The elastic material 88 located in the opening 87 serves as a tool retaining structure. The openings 85 and 87 are aligned to receive a single tool. The elastic material 88 is preferably deposited in the housing 82 during molding of the tool holder 80, creating an integrally formed, unitary structure from two or more polymeric materials. The housings 81, 82 provide tool retaining structures 84, 88 with a different durometer, resulting in different frictional engagement forces with the tool.

Figure 5:
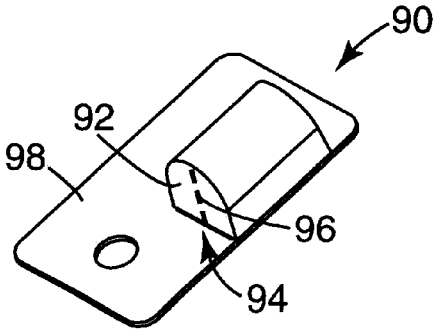
FIG. 5 is a perspective view of an alternate tool holder with a frangible portion including a single row of perforations in accordance with the present invention.

FIG. 5 is a perspective view of an alternate tool holder 90 with a tool retaining structure 92 that extends across the first opening 94. The tool retaining structure 92 is a thin film or membrane having a series of perforations 96 extending perpendicular to the substrate 98. The perforations 96 may be uniform or non-uniform depending on the application. In one embodiment, the perforations 96 closest to the substrate 98 are designed to be more easily frangible, while those further away from the substrate 98 require additional force in order to be severed. Consequently, the holding force applied by the tool retaining structure 92 to the tool (see FIG. 7A) can be engineered to accommodate tools of various cross sections shapes and sizes. Alternatively, the perforations 96 farthest from the substrate 98 are designed to be more easily frangible, while those closest to the substrate 98 require additional force in order to be severed.

Figure 6:
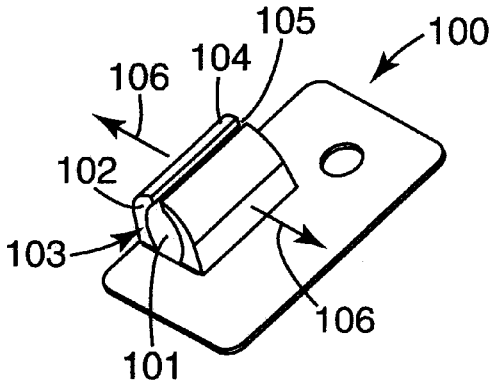
FIG. 6 is a perspective view of an alternate tool holder with a frangible portion having a non-circular aperture in accordance with the present invention.

FIG. 6 is a perspective view of an alternate tool holder 100 having an aperture 101 in the tool retaining structure 102 with a shape different from a cross sectional shape of the tool. The tool retaining structure 102 extends across only a portion of the second opening 103. The aperture 101 provides an interference fit and frictional engagement with the tool once inserted into the tool holder 100. The housing 104 may optionally be formed with a slit 105 along one surface to permit the two-parts housing 104 to flex outward in the directions 106 during tool insertion. The resiliency of the polymeric material provides a compressive force on the tool in a direction opposite the direction 106.

Figure 11:
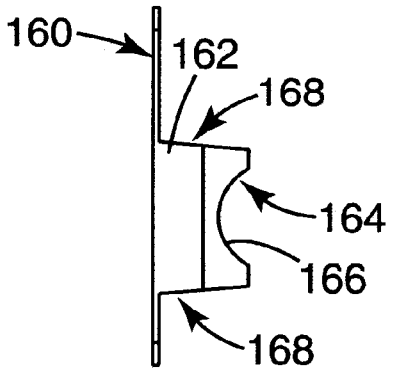
FIG. 11 is side sectional view of a tool holder with a housing that extends into a portion of the tool conduit in accordance with the present invention.

FIG. 11 is a side sectional view of a tool holder 160 with a housing 162 that extends into at least a portion of the tool conduit 168 in accordance with the present invention. The tool retaining structure 164 is a depression 166 in an upper portion of the housing 162. The depression 166 may be uniform or non-uniform depending on the application. For example, a non-uniform depression could be configured to facilitate inserting a tool into one opening, but not the other. The holding force applied by the tool retaining structure 164 can be engineered to accommodate tools of various cross sections shapes and sizes.

Figure 12:
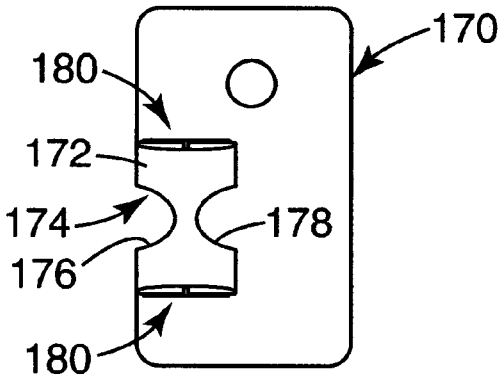
FIG. 12 is a front view of an alternate tool holder with a housing that extends into a portion of the tool conduit in accordance with the present invention.

FIG. 12 is a front view of the tool holder 170 with a housing 172 that extends into at least a portion of the tool conduit 180 in accordance with the present invention. The tool retaining structure 174 is formed as a pair of depressions 176, 178 located on opposing sides of the housing 172. The depressions 176, 178 extends at least partially into the tool conduit 180. The depressions 176, 178 may be uniform or non-uniform depending on the application. The holding force applied by the pair of depressions 176, 178 can be engineered to accommodate tools of various cross sections shapes and sizes.

FIGS. 3–6 and 11–12 illustrate a variety of tool retaining structures, including membranes with aperture and/or slits, a resilient material such as foam in the tool conduit, a longitudinal slit in the housing that permits flexure during insertion and removal of the tool and various irregularities in the housing that extend into the tool conduit. The various possible embodiments may be combined on a single tool holder. For example, one type of tool retaining structure may be used at the first opening of a housing, and a different tool retaining structure may be used at the second opening of the housing.

Figure 7A:
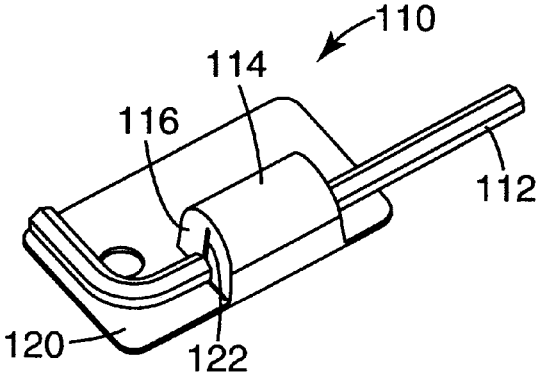
FIGS. 7A, 7B and 7C are perspective views of a combination tool and tool holder in accordance with the present invention.
Figure 7B:
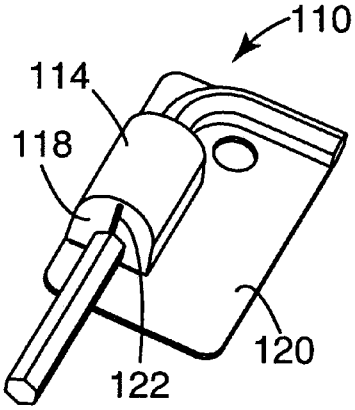
Figure 7C:
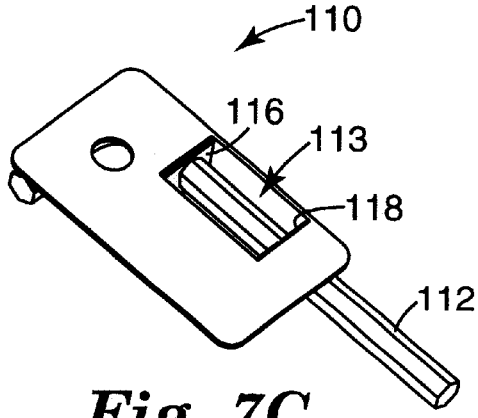

FIGS. 7A, 7B and 7C are perspective views of a tool holder 110 in accordance with the present invention. A medium sized tool 112 has been inserted through the tool conduit 113 of the housing 114, resulting in deformation of the top and bottom tool retaining structures, 116, 118 adjacent to the substrate 120. As is best seen in FIGS. 7A and 7B, frangible portions 122 extends beyond the cross sectional dimensions of the tool 112 so that tools having larger cross sections can be accommodated by the tool holder 110. A variety of hand tools may be retained in holders of the present invention, including hex wrenches, screwdrivers, TORX drivers, open end wrenches, box end wrenches or some combination thereof.

Figure 8A:
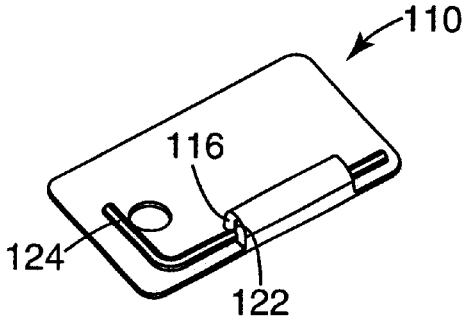
FIGS. 8A and 8B illustrate a different size tool retained to the tool holder illustrated in FIGS. 7A and 7B.
Figure 8B:
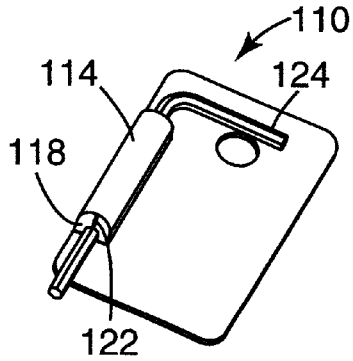
Figure 9A:
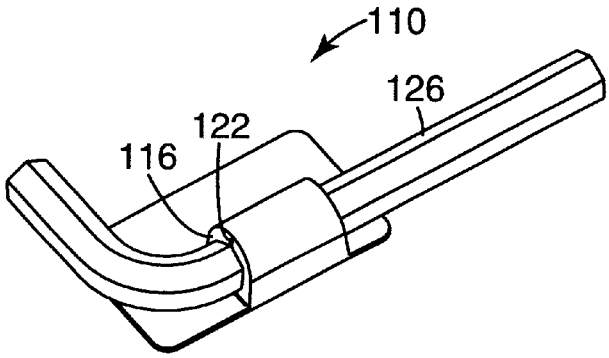
FIGS. 9A and 9B illustrate a larger tool retained in the tool holder of FIGS. 7A and 7B.
Figure 9B:
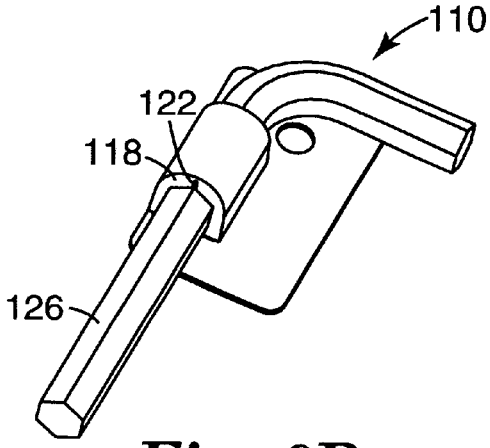

FIGS. 8A and 8B are perspective views of the tool holder 110 used for labeling and displaying a tool 124 with a considerably smaller cross sectional area than the tool 112. The frangible portion 122 is deformed only to the extent the cross section of the tool 124 penetrates the tool retaining structures 116, 118. That is, the frangible portion 122 permits the tool retaining structures 116, 118 to conform to the diameter of the tool 124. For example, FIGS. 9A and 9B illustrate the use of the tool holder 110 on a tool 126 that has a significantly larger cross section than either the tools 112 or 124. In the embodiment illustrated in FIGS. 9A and 9B, the tool 126 deforms the top tool retaining structure 116 and bottom tool retaining structure 118 along the full length of the frangible portion 122. Consequently, the tool holder 110 can accommodate tools of a variety of cross sections.

Figure 10:
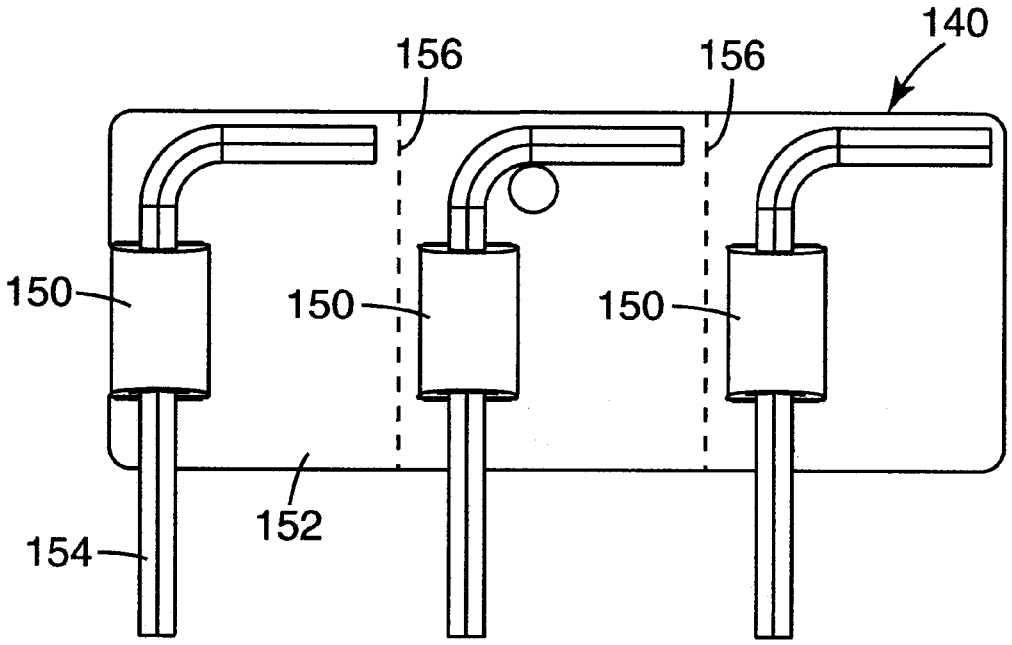
FIG. 10 illustrates multiple tool holders on a single substrate in accordance with the present invention.

FIG. 10 is an alternate embodiment in which a plurality of housings 150 are located on a single substrate 152. In the illustrated embodiment, the tools 154 are similar in size. Alternatively, the tool holder 140 illustrated in FIG. 10 can accommodate tools of significantly different size without modification. For example, a set of different size tools can be located in a series of housings 150 on a single tool holder 140. In another embodiment, the substrate 152 may include a series of perforations 156 so that consumers can break-off or remove a single tool and its respective tool holder from the larger sheet of tools 140.

The present tool holder is typically integrally formed as a unitary structure using conventional injection molding techniques. Alternatively, the housing and substrate may be formed separately and joined together by a variety of techniques, such as thermal bonding, adhesive bonding or solvent bonding. The substrate is typically about 1 millimeter to about 2 millimeters (0.04 inches to 0.080 inches) thick, although the present invention is not limited by the thickness of the substrate. The substrate may be a foamed or a solid polymeric material. In one embodiment, the substrate may include a fibrous material or fabric scrim, which may be woven or nonwoven. Suitable substrate materials include thermoplastic polyurethanes, polyvinyl chlorides, polyamides, polyimides, polyolefins (e.g., polyethylene and polypropylene), polyesters (e.g., polyethylene terephthalate), polystyrenes, nylons, acetals, block polymers (e.g., polystyrene materials with elastomeric segments, available from Shell Chemical Company of Houston, Tex., under the designation KRATON™, polycarbonates, thermoplastic elastomers (e.g. polyolefin, polyester or nylon types) and copolymers and blends thereof. The thermoplastic material may also contain additives, including but not limited to fillers, fibers, antistatic agents, lubricants, pigments, dyes, plasticizers, and the like. In another embodiment, the tool retaining structure may be constructed from a variety of metals, such as spring steel or aluminum using conventional stamping techniques.

In some embodiments, the tool retaining structures and/or the entire tool holder are constructed from an elastomeric material. The elastomeric material can be any thermoplastic elastomer that can be heated to a state in which it can be flowed and molded, such as those described in G. Holden et al., *Thermoplastic Elastomers*, ($2^{nd}$ ed. 1996). It is also within the scope of this invention to use two or more different thermoplastic elastomeric materials in either layered or blended form to define that portion of the slip control article.

The term "elastomer" or "elastomeric" is used to refer to rubbers or polymers that have resiliency properties similar to those of rubber. In particular, the term elastomer reflects the property of the material that it can undergo a substantial elongation and then return to its original dimensions upon release of the stress elongating the elastomer. In all cases an elastomer must be able to undergo at least 10% elongation (at a thickness of 0.5 mm), and more preferably at least 30% elongation, and return to at least 50% after being held at that elongation for 2 seconds and after being allowed 1 minute relaxation time. More typically, an elastomer can undergo 25% elongation without exceeding its elastic limit. In some cases elastomers can undergo elongation to as much as 300% or more of their original dimensions without tearing or exceeding the elastic limit of the composition. Elastomers are typically defined to reflect this elasticity as in ASTM Designation D883-96 as a macromolecular material that at room temperature returns rapidly to approximately its initial dimensions and shape after substantial deformation by a weak stress and release of the stress. ASTM Designation D412-98A can be an appropriate procedure for testing rubber properties in tension to evaluate elastomeric properties.

Patents and patent applications disclosed herein, including those disclosed in the background of the invention, are hereby incorporated by reference. The present invention has now been described with reference to several embodiments described herein. It will be apparent to those skilled in the art that many changes can be made in the embodiments without departing from the scope of the invention. Thus, the scope of the present invention should not be limited to the methods and structures described herein, but only to methods and structures described by the language of the claims and the equivalents thereof.

What is claimed is:

1. A holder for labeling and displaying a tool, comprising:

a substrate having at least one housing comprising a tool conduit with first and second openings, the tool conduit comprising a cross sectional area capable of receiving the tool;

at least one tool retaining structure comprising a film extending across at least a portion of each of the first and second openings adapted to generate a frictional engagement force between the tool and the tool retaining structure, the tool conduit comprising an opening interposed between the tool retaining structures, the housing, substrate and tool retaining structure being molded as a unitary structure from a polymeric material.

2. The holder of claim 1 further comprising information displayed on an information receiving surface on the substrate.

3. The holder of claim 1 further comprising a substrate mounting hole formed in the substrate.

4. The holder of claim 1 wherein the housing, substrate, and tool retaining structure comprise one or more polymeric materials.

5. The holder of claim 1 further comprising a resilient material located in the tool conduit.

6. The holder of claim 1 wherein the tool retaining structure comprises an aperture adapted to have a shape different than a cross sectional shape of the tool.

7. The holder of claim 1 wherein the tool retaining structure comprises an aperture in the tool retaining structure smaller than a cross sectional area of the tool.

8. The holder of claim 1 wherein the housing includes a longitudinal slit generally along the tool conduit that permits flexure of the housing during insertion and removal of a tool.

9. The holder of claim 1 wherein the tool retaining structure is integral with the housing.

10. The holder of claim 1 wherein the tool retaining structure comprises at least a portion of the housing extending into at least a portion of the tool conduit.

11. The holder of claim 1 wherein the tool retaining structure comprises at least one or more depressions in the housing extending into a portion of the tool conduit.

12. The holder of claim 1 wherein the tool retaining structure comprises a frangible portion.

13. The holder of claim 12 wherein the frangible portion comprises a plurality of perforations on the tool retaining structure.

14. The holder of claim 12 wherein the frangible portion comprises a plurality of perforations on the tool retaining structure forming a non-linear pattern.

15. The holder of claim 13 wherein the frangible portion comprises at least one slit in the tool retaining structure.

16. The holder of claim 1 wherein the at least one housing comprises a plurality of housings.

17. A holder for labeling and displaying a tool, comprising:

a substrate having at least one label receiving surface;

at least one housing comprising a tool conduit with first and second openings, the housing and the substrate being molded as a unitary structure from one or more polymeric material; and a tool retaining structure molded with the housing comprising a polymeric membrane extending across at least a portion of each of the first and second openings adapted to frictionally engagement with the tool, the tool conduit comprising an opening interposed between the tool retaining structures.

18. A holder for labeling and displaying a tool, comprising:

a substrate having at least one housing comprising a tool conduit with first and second openings, the tool conduit comprising a cross sectional area capable of receiving the tool, the housing and the substrate being molded as a unitary structure from one or more polymeric material;

at least one tool retaining structure molded with the housing comprising a polymeric film extending across at least a portion of each of the first and second openings, the tool conduit comprising an opening interposed between the tool retaining structures; and a resilient material located in the tool conduit positioned to generate a frictional engagement force with the tool.

19. The holder of claim 18 wherein the resilient material comprises a polymeric foam material.

20. A combination tool and holder for labeling and displaying the tool, comprising:

a substrate having at least one housing comprising a tool conduit with first and second openings, the tool conduit comprising a cross sectional area capable of receiving the tool, the housing and the substrate being molded as a unitary structure;

at least one tool retaining structure comprising a polymeric film molded with the housing extending across at least a portion of the first and second openings adapted to generate a frictional engagement force between the tool and the tool retaining structure, the tool conduit comprising an opening interposed between the tool retaining structures; and a tool extending through the tool conduit and forming a frictional engagement with the tool retaining structure.

21. The article of claim 20 wherein the tool is one or more of hex wrenches, screwdrivers, ball drivers, open end wrenches, box end wrenches or some combination thereof.

22. The article of claim 20 wherein the housing, substrate, and tool retaining structure comprise one or more polymeric materials.

23. A method for labeling and displaying a tool, comprising the steps of:

molding a unitary structure of at least one housing comprising a tool conduit with first and second openings, a tool retaining structure comprising a polymeric film extending across at least a portion of each of the first and second openings so that the tool conduit comprises an opening interposed between the tool retaining structures, and a frangible portion on the tool retaining structure; and inserting a tool through the tool conduit so that a frictional engagement force is generated between the tool and the tool retaining structure.

24. The method of claim 23 further comprising the step of applying a label to the label receiving surface.

25. The method of claim 23 wherein the step of forming a frangible portion on the tool retaining structure comprises at least one of forming one or more slits in the tool retaining structure, forming one or more perforations in the tool retaining structure, forming an aperture in the tool retaining structure having a shape different than a cross sectional shape of the tool, forming an aperture in the tool retaining structure smaller than a cross sectional area of the tool, or forming the tool retaining structure from an elastomeric material.

* * * * *